US009246269B2

(12) United States Patent
Peng

(10) Patent No.: US 9,246,269 B2
(45) Date of Patent: Jan. 26, 2016

(54) CONNECTOR WITH A GUIDING PORTION

(71) Applicant: Tyco Electronics Holdings (Bermuda) No. 7 Limited, Pembroke (BM)

(72) Inventor: Sheng Wen Peng, Taipei (TW)

(73) Assignee: Tyco Electronics Holdings Bermuda) No. 7 Ltd., Pembroke (BM)

( * ) Notice: Subject to any disclaimer, the term of this patent is extended or adjusted under 35 U.S.C. 154(b) by 0 days.

(21) Appl. No.: 13/862,011

(22) Filed: Apr. 12, 2013

(65) Prior Publication Data

US 2013/0273768 A1 Oct. 17, 2013

(30) Foreign Application Priority Data

Apr. 13, 2012 (TW) ..... 101206802

(51) Int. Cl.
*H01R 13/629* (2006.01)
*H01R 12/83* (2011.01)

(52) U.S. Cl.
CPC ..... *H01R 13/629* (2013.01); *H01R 12/83* (2013.01)

(58) Field of Classification Search
USPC ..... 439/374, 378, 248, 676, 567
See application file for complete search history.

(56) References Cited

U.S. PATENT DOCUMENTS

| | | | | |
|---|---|---|---|---|
| 4,820,180 | A * | 4/1989 | Mosquera et al. | 439/248 |
| 5,466,171 | A * | 11/1995 | Bixler et al. | 439/378 |
| 6,142,834 | A * | 11/2000 | Liao | 439/676 |
| 6,238,219 | B1 * | 5/2001 | Wu | 439/74 |
| 6,331,122 | B1 * | 12/2001 | Wu | 439/567 |
| 6,334,794 | B1 * | 1/2002 | Crane et al. | 439/680 |
| 6,565,390 | B2 * | 5/2003 | Wu | 439/680 |
| D491,528 | S * | 6/2004 | Fan | D13/147 |
| 6,932,656 | B2 * | 8/2005 | Kan | 439/681 |
| 7,172,444 | B1 * | 2/2007 | Huang et al. | 439/260 |
| 7,311,525 | B2 * | 12/2007 | Koiwaya et al. | 439/31 |
| 7,704,089 | B2 * | 4/2010 | Tseng | 439/248 |
| 8,608,503 | B2 * | 12/2013 | Kagotani | 439/378 |
| 8,814,585 | B2 * | 8/2014 | Yu et al. | 439/247 |
| 2012/0077379 | A1 * | 3/2012 | Zhang et al. | 439/607.01 |
| 2013/0273768 | A1 * | 10/2013 | Peng | 439/374 |

FOREIGN PATENT DOCUMENTS

| | | |
|---|---|---|
| TW | M278110 | 10/2005 |
| TW | M315421 | 7/2007 |
| TW | M346145 | 5/2008 |
| TW | M353509 | 9/2008 |
| TW | M376971 | 9/2009 |
| TW | M370869 U | 12/2009 |
| TW | M385131 | 7/2010 |

* cited by examiner

*Primary Examiner* — Alexander Gilman
(74) *Attorney, Agent, or Firm* — Barley Snyder

(57) ABSTRACT

The invention is directed towards a connector with a guiding portion having a housing, a connecting interface having a plurality of conductive terminals, and a first guiding post disposed along the housing, whereby the first guiding post has a sloping guiding portion.

16 Claims, 10 Drawing Sheets

CONNECTOR WITH A GUIDING PORTION

CROSS-REFERENCE TO RELATED APPLICATIONS

This application claims the benefit of the filing date under 35 U.S.C. §119(a)-(d) of Taiwanese UM Application No. 101,206,802 filed on Apr. 13, 2012.

FIELD OF INVENTION

The invention relates to an electrical connector and more particularly, to a connector with a guiding portion.

BACKGROUND

Advanced Technology Attachment ("ATA") is an interface standard for electronic data storage devices, whereby a controller is integrated on a device itself and serves as a communication interface between the device and a motherboard. Parallel ATA ("PATA") and Serial ATA ("SATA") are two subsequent interface standards developed from early ATA technology. However, the PATA interface has a limited transmission bandwidth, and is inadequate for modern applications using central processing units ("CPU") with higher processing speeds. The SATA interface has largely replaced PATA as the interface of choice, because it features higher transmission efficiency, among other advantages.

A conventional SATA connector is shown in FIG. 1. The interface of a conventional SATA connector generally includes one end disposed on a hard drive 10 while another end is generally disposed on a printed circuit board (PCB) 11. This connecting method is generally completed by engaging the hard drive 10 and the PCB 11 in a horizontal direction 12. Such an mating arrangement usually requires a fixed-size receiving space 13 to provide the hard drive 10 with some leeway in movement during insertion, and also to prevent the hard drive 10 from colliding with other members 14 during insertion. Although the fixed-size receiving space 13 is necessary, it is not space efficient. Moreover, the horizontal direction 12 of force required for mating of the hard drive is not a natural direction in which a user exerts force, thus hindering the efficiency of insertion or removal of the hard drive.

Another exemplary prior art SATA connector is illustrated in FIGS. 2A and 2B. As shown, one end of the conventional SATA connector is disposed on a hard drive 20 while another end thereof is disposed on a PCB 21. This SATA connector is different from FIG. 1's conventional SATA connector, in that an adaptor 201 is arranged at the end of its interface and disposed on the hard drive 20. The corresponding end of the interface disposed on the PCB 21 is rotated upwards 90 degrees so that the two corresponding ends of the interface are engaged along a vertical direction 22. However, this mating arrangement requires an additional adaptor 201, which adds additional manufacturing costs as well as additional complexity.

Moreover, Taiwan Utility Model Patents No. M346145, M353509, M376971, and M385131 disclose technical features relevant to the guiding portions of the connectors; Taiwan Utility Model Patent No. M278110 discloses technical features relevant to the positioning post of a connector; Taiwan Utility Model Patent No. M315421 discloses technical features relevant to the complementary track of a connector. However, the aforementioned features are not desirable in practice.

Therefore, a need exists in the art for a connector with a guiding portion that is capable of improving the aforementioned prior art detects, efficiently utilizing a smaller receiving space to tightly mate a SATA connector.

SUMMARY

In view of the aforementioned problems in the prior art, the present invention is directed towards a connector with a guiding portion having a housing, a connecting interface having a plurality of conductive terminals, and a first guiding post disposed along the housing, whereby the first guiding post has a sloping guiding portion.

BRIEF DESCRIPTION OF THE DRAWINGS

The above and other objects, features, and other advantages of the present invention will be more clearly understood from the following detailed description taken in conjunction with the accompanying drawings, in which.

DETAILED DESCRIPTION

The invention will be fully described by way of embodiments and appended drawings to facilitate the understanding of the technical features, contents, and advantages of the invention and the effect achieved thereby. It will be understood by those of ordinary skill in the art that the appended drawings are merely exemplary embodiments and may not be illustrated according to actual scale and precise arrangement of the implemented invention. Therefore, the scope of protection of the invention shall not be construed based on the scale and arrangement illustrated on the appended drawings nor limited thereto.

Figure 1:
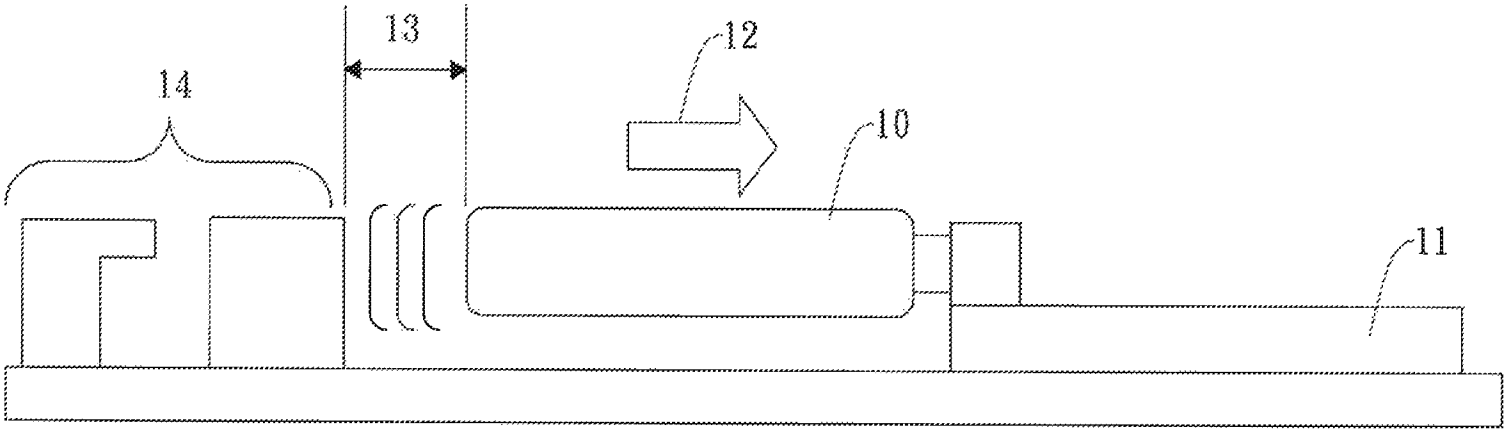
Prior Art Fig. 1
FIG. 1 is a schematic representation showing a conventional SATA connector.
Figure 2A:
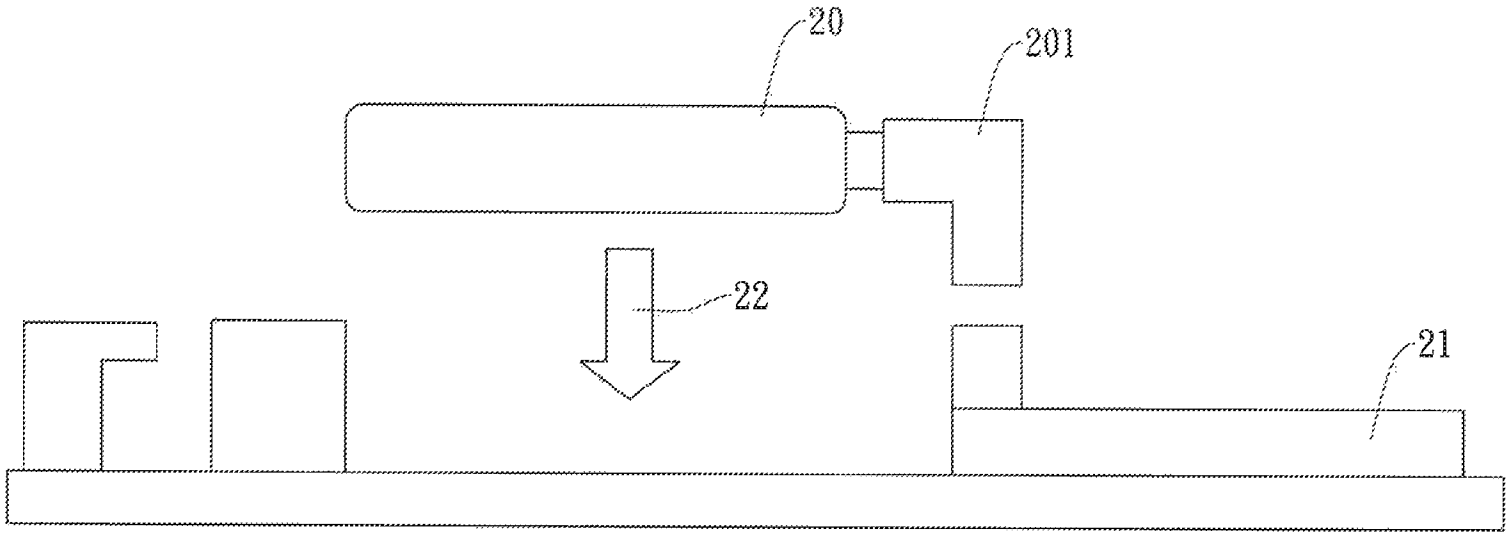
Prior Art Fig. 2A
FIGS. 2A and 2B are schematic representations showing another exemplary conventional SATA connector.
Figure 2B:
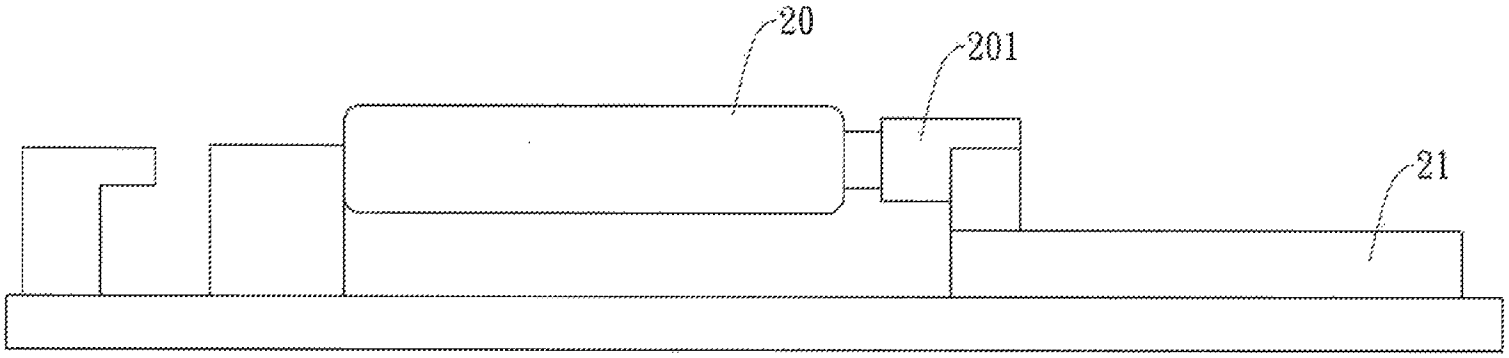
Fig. 2B Prior Art
Figure 3:
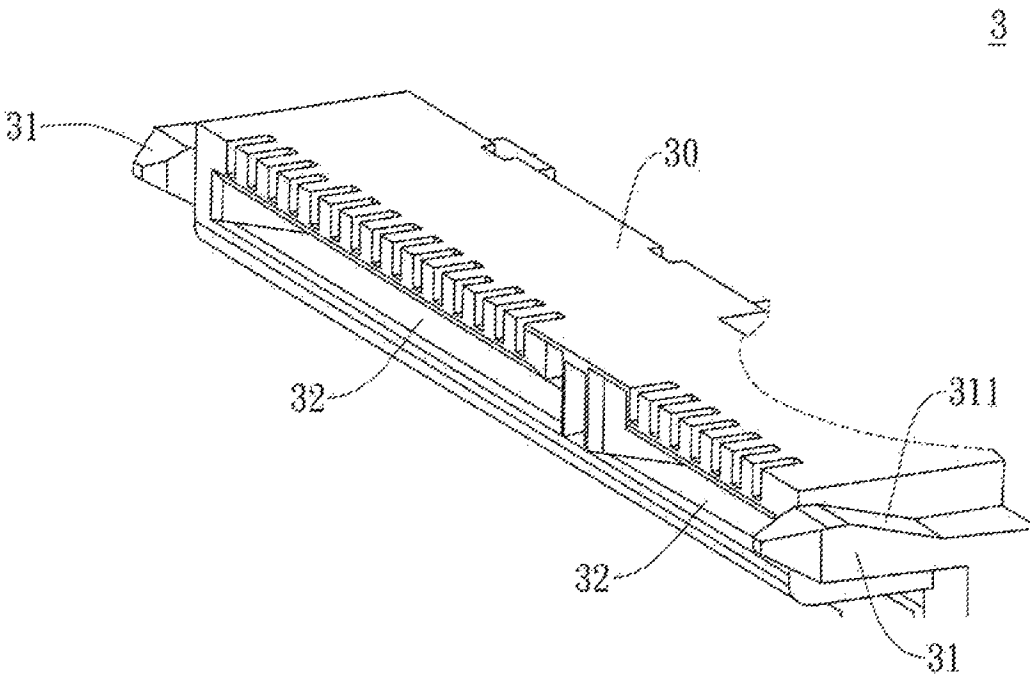
FIG. 3 is a perspective view showing a connector with a guiding portion according to the invention.

With reference to FIG. 3, a connector 3 is shown and, in particular, the connector 3 is shown with a guiding portion 311. As shown in FIG. 3, the connector 3 includes a housing 30, a guiding post 31 and a connecting interface 32. However, it should be understood by one skilled in art that the, connector 3 may have more than one guiding post 31, as shown in FIG. 3.

Figure 4:
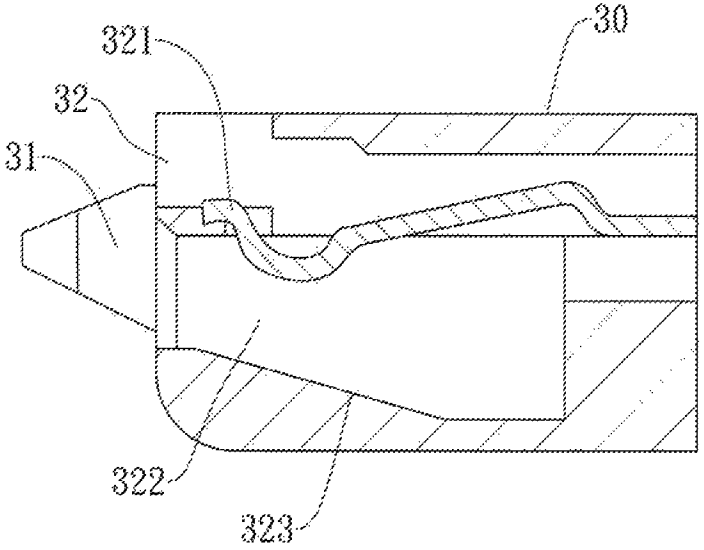
FIG. 4 is a sectional view of the connector with a guiding portion shown in FIG. 3.

As shown in FIGS. 3 and 4, the connecting interface 32 can include a plurality of conductive terminals 321 and provides a connector receiving passageway 322 having an oblique lower wall 323 along with the housing 30 so as to mate with a corresponding connector (not shown).

Figure 5:
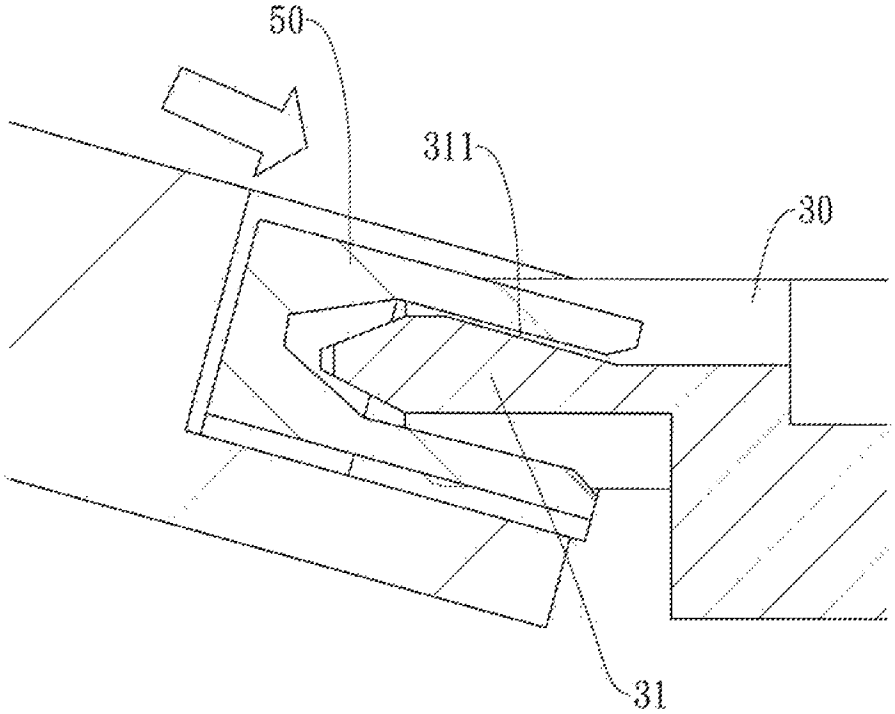
FIG. 5 is a sectional view showing mating of a connector with a guiding portion and a corresponding connector.

As shown in FIG. 5, the guiding post 31 may have a sloping guiding portion 311. In another embodiment, two guiding posts 31 may be disposed on the housing, with one of each being located at the proximal and distal sides of the connector 3 with a guiding portion. In another embodiment, the sloping guiding portions 311 at the proximal and distal sides may be inclined at the same or different angles. In an embodiment, the sloping guiding portion 311 is inclined at different angles towards the housing. In another embodiment, the oblique lower wall 323 and the sloping guiding portion 311 can be inclined at the same or different angles. In yet another embodiment, the oblique lower wall 323 and the sloping guiding portion 311 are inclined at the same angle.

As further shown in FIG. 5, a mating connector 50 may be provided, for example, with a hard drive and is matable with the connector 3 having a guiding portion under the guiding of the sloping guiding portion 311.

In another exemplary embodiment, the connecting interface 32 conforms to at least one of the following standards: SATA, mini SATA, Slimline SATA and micro SATA.

Figure 6A:
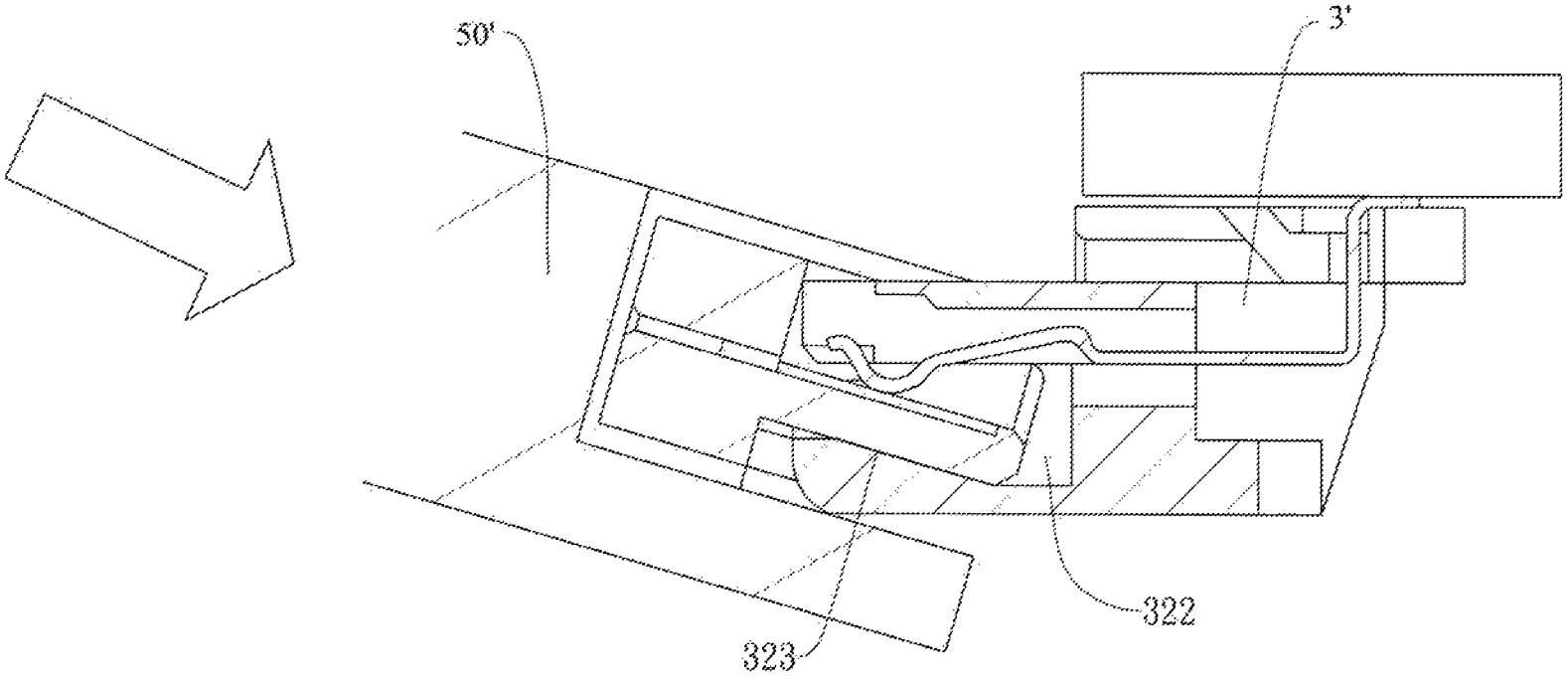
FIGS. 6A and 6B are sectional views showing mating of a connector with a guiding portion and a corresponding connector in another manner.
Figure 6B:
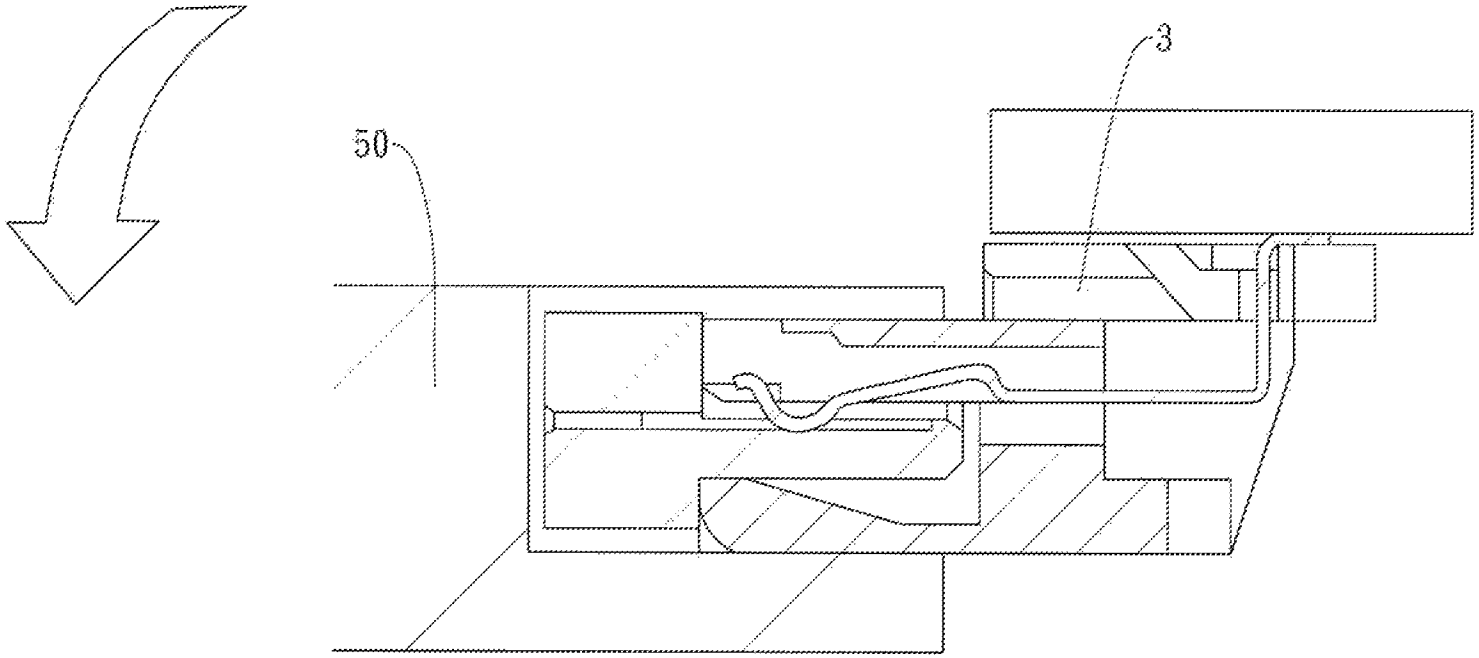

With reference to FIGS. 6A and 6B, another connector 3' having a guiding portion is shown. It is matable with a mating connector 50' in another manner. In the shown embodiment, the mating connector 50' is obliquely inserted into the connector 3' with a guiding portion under the guiding of an oblique lower wall 323 of a connector receiving passageway 322 and then rotated as shown by the arrow in FIG. 6B to complete mating with the connector 3'. In another embodiment, the corresponding connector 50' is disposed on an electronic device. In another embodiment, the electronic device is an electronic data storage device. In yet another embodiment, the electronic data storage device is a hard drive.

Figure 7A:
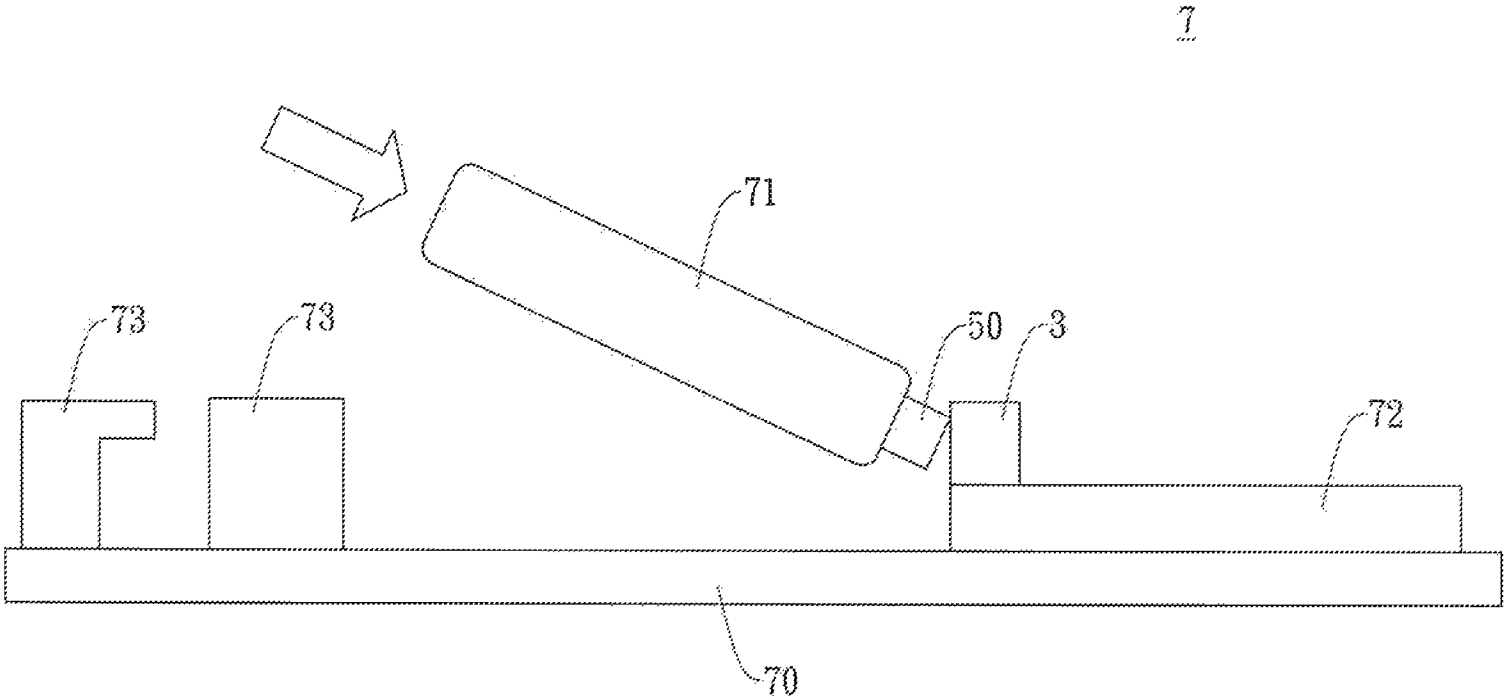
FIGS. 7A and 7B are schematic representations showing an electronic device having a connector with a guiding portion.
Figure 7B:
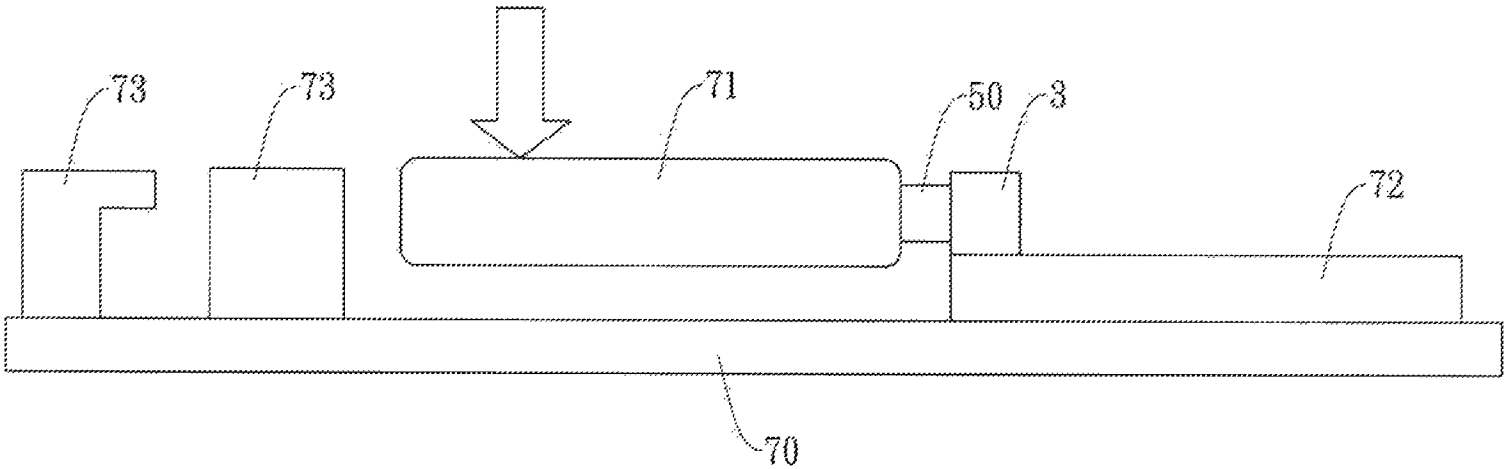

With reference to FIGS. 7A and 7B, an electronic device 7 having a connector 3 with a guiding portion is shown. In the shown embodiment, an electronic device 7 includes a main body, a hard drive 71, a PCB 72, and other members 73 arranged therein. In an embodiment, the hard drive 71 can include a corresponding connector 50. In another embodiment, the PCB 72 can include the connector 3 with a guiding portion. In yet another embodiment, a corresponding connector 50 at one end of the hard drive 71 of the electronic device 7 can be obliquely inserted into the connector 3 having a guiding portion, and in particular, under the guiding of an oblique lower wall 323 of connector receiving passageway 322, and the sloping guiding portion 311 of the guiding post 31. The hard drive 71 can then be moved downwardly to complete mating with the connector 3 with a guiding portion on the PCB 72.

This mating arrangement is accordant with the direction in which the user exerts force, thus relevant members can be inserted or removed easily. Moreover, this mating arrangement does not require an additional fixed-size receiving space which is required for a conventional SATA connector so that the overall space can be utilized more efficiently.

A person having ordinarily skill in the art will understand that the types of sloping guiding portions in the embodiments are exemplary and are not intended to limit the invention. The embodiments depicted above and the appended drawings are exemplary and are not intended to limit the scope of the invention.

The exemplary embodiments directed towards a connector having a guiding portion allows an electronic device having the connector with a guiding portion to be mated with a corresponding connector without any additional fixed-size receiving spaces, and thus significantly increases spatial utilization efficiency. Additionally, the design of the connector having a guiding portion is simple and eliminates the need for an additional adaptor.

What is claimed is:

1. A connector with a guiding portion comprising:
a housing;
a connecting interface having
a connector receiving passageway extending into the housing along a longitudinal axis, and having a lower wall extending inward towards the housing along the connector receiving passageway at an oblique angle to the longitudinal axis, and a plurality of conductive terminals positioned in the connector receiving passageway; and
a first guiding post disposed along the housing, and having a sloping guiding portion.

2. The connector with a guiding portion according to claim 1, whereby the connecting interface mates with a complementary connector.

3. The connector with a guiding portion according to claim 1, whereby a complementary connector is permitted to engage the connector receiving passageway at an oblique angle.

4. The connector with a guiding portion according to claim 1, whereby the oblique lower wall and the sloping guiding portion are inclined at the same angle with respect to the longitudinal axis.

5. The connector with a guiding portion according to claim 1, further comprising a second guiding post positioned along the interface on the housing, opposite the first guiding post and having another sloping guiding portion.

6. The connector with a guiding portion according to claim 5, whereby the first and second guiding posts are disposed along proximal and distal sides of the housing.

7. The connector with a guiding portion according to claim 5, whereby the sloping guiding portions of the first and second guiding posts are inclined at different angles with respect to the longitudinal axis, toward the housing.

8. The connector with a guiding portion according to claim 1, whereby the connecting interface conforms to at least one of the following standards: SATA, mini SATA, Slimline SATA and micro SATA.

9. The connector with a guiding portion according to claim 2, wherein the complementary connector is disposed on an electronic device.

10. The connector with a guiding portion according to claim 9, wherein the electronic device is an electronic data storage device.

11. The connector with a guiding portion according to claim 10, wherein the electronic data storage device is a hard drive.

12. A connector with a guiding portion comprising:
a housing;
a connecting interface having
a plurality of conductive terminals, and
a connector receiving passageway extending into the housing along a longitudinal axis, and having a lower wall extending inward towards the housing at an oblique angle to the longitudinal axis to engage a corresponding connector, the corresponding connector being inserted into the connector receiving passageway at the oblique angle, and being rotated to the longitudinal axis to contact the conductive terminals in a final mating position; and
a first guiding post and a second guiding post disposed on opposite sides along the housing, with each guiding post having a sloping guiding portion.

13. The connector with a guiding portion according to claim 12, whereby the oblique lower wall and the sloping guiding portion are inclined at the same angle with respect to the longitudinal axis.

14. The connector with a guiding portion according to claim 12, wherein the second guiding post is positioned along the interface on the housing, opposite the first guiding post and has another sloping guiding portion.

15. The connector with a guiding portion according to claim 14 whereby the first and second guiding posts are disposed along proximal and distal sides of the housing.

16. The connector with a guiding portion according to claim 14, whereby the sloping guiding portions of the first and second guiding posts are inclined at different angles with respect to the longitudinal axis toward the housing.

* * * * *